US006922952B2

(12) United States Patent
Htoon

(10) Patent No.: US 6,922,952 B2
(45) Date of Patent: Aug. 2, 2005

(54) CONSTRUCTION SYSTEM FOR FILTERING PARTICLES AND DISSIMULATING ARTIFICIAL STRUCTURES IN DESERT LANDSCAPING BY DEFINING AND USING STONE CONFIGURATIONS

(76) Inventor: Philip M. Htoon, 8010 E. Wingspan Way, Scottsdale, AZ (US) 85255

( * ) Notice: Subject to any disclaimer, the term of this patent is extended or adjusted under 35 U.S.C. 154(b) by 0 days.

(21) Appl. No.: 10/444,555

(22) Filed: May 23, 2003

(65) Prior Publication Data

US 2004/0231281 A1 Nov. 25, 2004

(51) Int. Cl.[7] ..... E02D 27/00
(52) U.S. Cl. ..... 52/102; 52/169.1; 239/69
(58) Field of Search ..... 52/102, 169.1, 52/169.2, 169.3; 47/33; 239/69, 273, 276, 279, 200, 201, 204, 536; 405/36

(56) References Cited

U.S. PATENT DOCUMENTS 5,133,501 A * 7/1992 Marshall ..... 239/201
5,313,677 A * 5/1994 Coe ..... 4/683
5,377,447 A * 1/1995 Fritch ..... 47/33
5,584,991 A * 12/1996 Wittstock et al. ..... 210/151
5,715,866 A * 2/1998 Granger ..... 137/624.11
6,041,738 A * 3/2000 Hemauer et al. ..... 119/226
6,128,852 A * 10/2000 Hansen ..... 47/32
6,248,411 B1 * 6/2001 Warfel ..... 428/15
6,290,844 B1 * 9/2001 Tennyson, Jr. ..... 210/169

* cited by examiner

*Primary Examiner*—Chi Q. Nguyen
(74) *Attorney, Agent, or Firm*—Tod R. Nissle, P.C.

(57) ABSTRACT

A construction system includes a building structure, grounds adjacent the building structure, and artificial structures in the grounds. The artificial structures includes a water system with a valve box. The valve box includes a cover. The system also includes means for dissimulating the cover, and for preventing stones and other particles from penetrating and accumulating in the box to adversely affect operation of valves in the box.

1 Claim, 4 Drawing Sheets

CONSTRUCTION SYSTEM FOR FILTERING PARTICLES AND DISSIMULATING ARTIFICIAL STRUCTURES IN DESERT LANDSCAPING BY DEFINING AND USING STONE CONFIGURATIONS

This invention pertains to construction systems.

More particularly, the invention pertains to a construction system including a building structure, grounds adjacent the building structure, and artificial structures in the grounds.

In a further respect, the invention pertains to a building construction system for dissimulating artificial out-of-doors structures.

In the desert Southwest of the United States, irrigation or other watering systems are frequently utilized in combination with desert landscaping to minimize water consumption. Desert landscaping typically includes palm trees and other desert plants utilized in combination with ground cover that consists of stones. Such stones can include decorative rocks or gravel. The ground cover can be pre-existing at the time a building structure is constructed or can be installed at the time landscaping of the grounds around the building structure is achieved.

During the installation of stone, black plastic or another sheet material is usually applied to the surface of the ground, and the stone is then spread on top of the plastic in a quantity sufficient to cover the plastic. It often is preferred that a water permeable fabric be utilized instead of black plastic.

The stone applied to the plastic or other sheet material, as the case may be, can includes stones that vary in shape, size, and color according to the wishes of the individual or other entity that owns the building structure. In some cases the stones are small, less than a millimeter in width, and comprise sand. In other cases the stones are large, three inches or more wide, and comprise river rock. The stones can have a smooth arcuate surface, as is the case with river rock, or can have rough angular surfaces, as is the case with crushed stone. The size distribution of the stones installed over plastic on the ground can be relatively uniform, as is the case with pea gravel, or can vary, as is the case of ABC gravel. Similarly, the color of the stones can vary. Some stones are pink, others red, others gold, other white, etc. The stone can comprise a plurality of colors, as is the case with river rock. River rock typically includes stones having blue, gray, and white shades of color.

The thickness of a layer of stone is applied as ground cover can vary as desired. The thickness of the stone layer typically increases as the size of stones in the layer increases. The thickness of the layer ordinarily is between one-half inch and several inches.

Sprinkler and other watering or irrigation systems utilized on the grounds adjacent a building structure typically include at least one length of conduit. The conduit can be substantially rigid, as often is the case with PVC, or can be pliable. The conduit is usually buried in the ground.

The proximate end of the conduit includes at least one valve that is opened and closed to either allow water to flow under pressure through the valve into the conduit or to prevent water from flowing through the valve into the conduit. The valve can be manually operated, or, can be electrically operated, hydraulically operated, etc. as desired. Many watering system include a control box that, when set, automatically opens the valve at a particular time(s) of day and closes the valve at a particular time(s) of day.

The distal end of the conduit includes a water distribution valve comprising, for example, a sprinkler head, a valve that lets water drip out slowly, or some other water distribution apparatus.

The valve on the proximate end of the conduit typically is located below the surface of the ground in a box. The box, termed a valve box, is artificially produced from plastic, but can be fabricated from metal, concrete, or other materials. The box includes sides and a removable top, and normally does not include a bottom. The top or cover of the box rests on a ledge that is inset from the top peripheral rim or edge of the box. An opening is formed through the top to facilitate removal of the top from the box. The top of the box often is flush with the ground to minimize disruption by the box of the appearance of the surrounding landscape comprised of plants, stone, trees, and other natural materials.

Artificially produced containers or structures other than valve boxes are often found on the grounds of a building structure and include hollow metal or plastic boxes that are mounted on and extend upwardly from the ground and house telephone switches, lines, or other components; include hollow metal or plastic boxes that house electrical lines and components; include concrete bases or hollow bases that support light posts, etc. Each such artificially produced container or structure usually does not benefit the aesthetic appearance of the landscaping adjacent a home or other building structure.

A valve box can, instead of sprinkler system valves, also house a valve that controls the main water line leading to a building structure, or, can house a valve or valves that control gates that permit an area or areas of ground to be flooded and covered (i.e., irrigated) with water.

Some stone ground coverings includes a large proportion of fines. Fines are small stone particles, typically the size of sand particles or smaller. Even ground coverings comprised of large stones greater than three inches in width include some fines and some smaller particles. A particular problem associated with valve boxes is that fines and smaller stones fall into the space between the perimeter of the cover and the peripheral top edge of a valve box. These particles, or small stones, find their way into the valve box and accumulate around the valve or valves in the box. The particles tend to gradually cover the valves, to penetrate valve seals, to interfere with operation of the valves, and accelerate degradation of the valves. The particles also tend to wedge between the box cover and the peripheral edge of the box, making removal of the cover difficult. The foregoing problems tend to be aggravated because when a valve box is installed, the cover is flush with the ground. The stones comprising the ground cover adjacent the box extend above the ground and above the cover, increasing the likelihood that stones and particulate will fall or travel downwardly from the ground over onto the box cover and into the space between the perimeter of the cover and the peripheral top inset edge of the valve box.

Accordingly, it would be highly desirable to provide an improved construction system that would extend the life of valves positioned in the ground and housed in valve boxes and that would improve the aesthetic appearance of the grounds adjacent a residence or other building structure.

Therefore, it is a principal object of the invention to provide an improved construction system.

A further object of the invention is to provide an improved construction system that extends the life of valves in a valve box by altering the construction of the valve box.

Another object of the invention is to provide an improved construction system that minimizes the aesthetic disruption produced by a valve box and other artificial containers on the grounds of a building structure.

These and other, further and more specific objects and advantages of the invention will be apparent from the following detailed description of the invention, taken in conjunction with the drawings, in which.

Briefly, in accordance with my invention, I provide an improved construction method for capturing particles and altering the aesthetic appearance of desert landscaping by dissimulating at least one out-of-doors artificial. The improved construction method includes the step of selecting a building structure including grounds comprising ground and landscaping on the ground. At least a portion of the grounds including desert landscaping comprising stones on the ground. The building structure includes a watering system including at least one conduit having a proximate end and a distal end; at least one valve in the portion of the grounds on the proximate end of the conduit; at least one water distribution valve at the distal end of the conduit; and, a valve box housing the valve and including a cover having an outer top surface. The method also includes the steps of locating the valve box on the grounds; and, defining the configuration of the desert landscaping stones to generate a defined configuration. The defined configuration includes a size distribution, shape distribution, and color distribution. The method also includes the steps of supplying auxiliary stones having the defined configuration; and, producing a particle filter and dissimulating the cover by securing the auxiliary stones to the outer top surface of the cover.

In another embodiment of the invention, I provide a construction system for filtering particles and dissimulating at least one out-of-doors artificial structure. The system includes a building structure, and grounds adjacent the building structure and including ground and landscaping. The system also includes a watering system. The watering system includes at least one conduit having a proximate end and a distal end; at least one valve in the portion of the grounds on the proximate end of the conduit; at least one water distribution valve at the distal end of the conduit; and, a valve box set in the ground and housing the valve and including a cover having an outer top surface; and desert landscaping including primary ground cover stones on the ground adjacent the valve box. The stones have a defined configuration including a size distribution, shape distribution, and color distribution. The construction system also includes auxiliary stones attached to the outer top surface of the cover and having the defined configuration. The auxiliary stones dissimulate the cover with respect to the primary ground cover stones adjacent the valve box.

Figure 1:
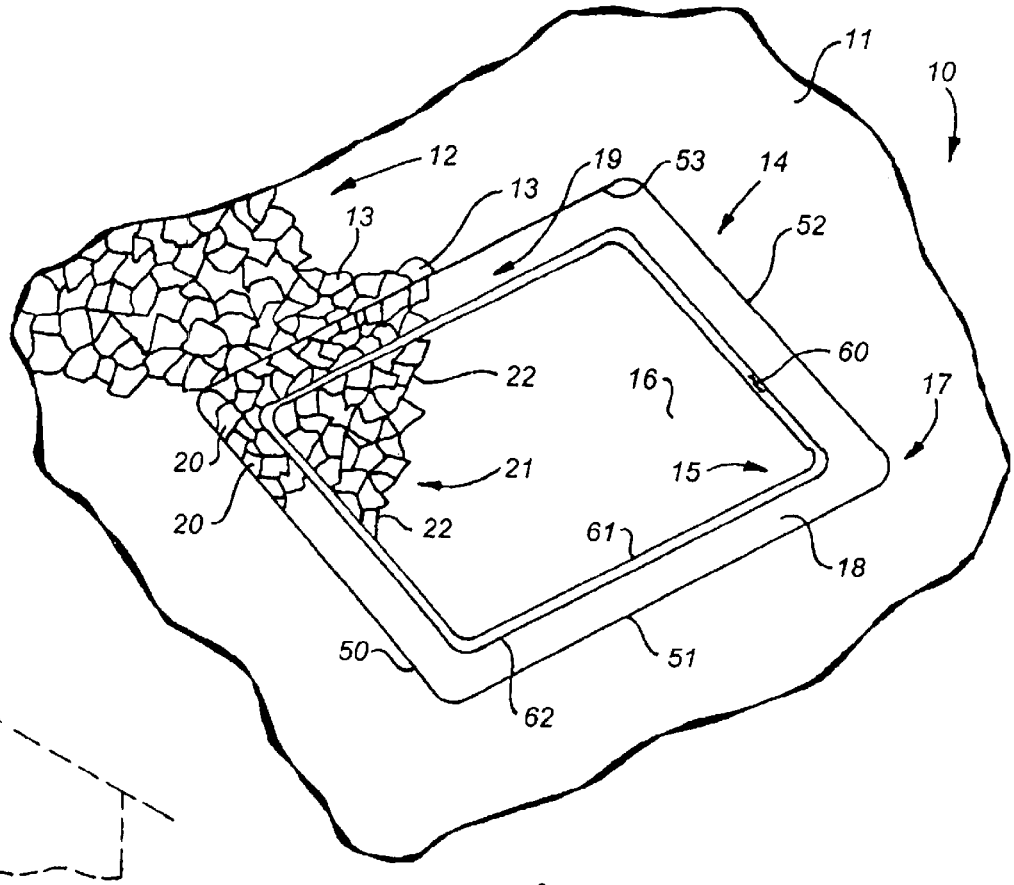
FIG. 1 is a perspective view illustrating a valve box and surrounding ground cover constructed in accordance with the invention.
Figure 2:
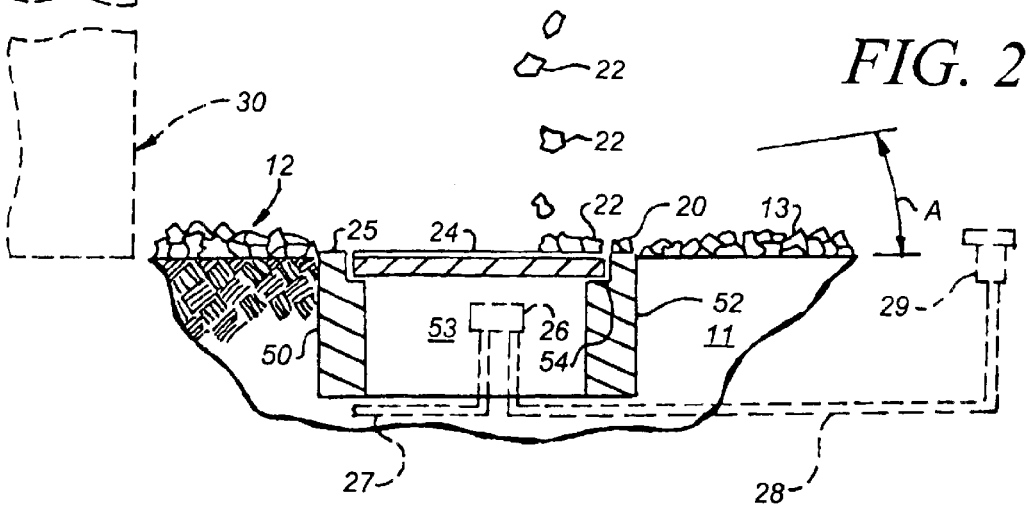
FIG. 2 is a side elevation partial section view illustrating in part the mode of operation of the construction system of the invention.

Turning now to the drawings, which depict the presently preferred embodiments of the invention for the purpose of illustrating the practice thereof and not by way of limitation of the scope of the invention, and in which like reference characters refer to corresponding elements throughout the several views, FIGS. 1 and 2 illustrate a construction system in accordance with the invention, and including a building structure 30 and grounds 10 adjacent the building structure. Grounds 10 include the ground 11 and a desert landscaping ground covering 12 including stones 13. Grounds 10 can also, as noted, include other landscaping including palm trees, cactus, or another other desired plants or structures. The ground covering need not be desert landscaping, but can consist of grass or any other desired conventional or non-conventional ground covering. The presently preferred embodiment of the invention, however, pertains to desert landscaping and stone ground coverings.

Valve box 14 includes hollow rectangular base 17 with vertically oriented sides 50, 52 normal to and interconnecting vertically oriented sides 51 and 53. Removable cover 15 rests on horizontally oriented inset peripheral edge 54. Cover includes horizontally oriented outer top surface 16. Base 17 includes horizontally oriented flat peripheral edge surface 18. Surface 18 circumscribes cover 15. One or more valves 26 are housed inside base 17 and beneath cover 15. A water line 27 carries pressurized water to valve 26. The proximate end of conduit 28 is connected to valve 26. The distal end of conduit 28 is connected to a sprinkler head 29, to a drip valve, or to some other apparatus to distribute water from conduit 28 onto ground 11.

Ground cover is applied to ground 11. The ground cover can include a plastic sheet or some other pliable sheet of material (not shown). Stone 12 are applied to cover ground 11, or to cover a plastic sheet that is first applied to ground 11. Stone 12 includes a plurality of stones 13, ordinarily in sufficient quantity to cover and obscure ground 11.

Stones 13 have a defined configuration comprising a selected shape distribution, a selected size distribution, and a selected color distribution.

One example of a selected shape distribution is a distribution in which each stone has the same shape or substantially the same shape. This type of shape distribution occurs in pea gravel. In pea gravel, each stone tends to be substantially oval or egg shaped. It is unusual for each stone 13 to have exactly the same shape.

Another example of a selected shape distribution is a distribution in which stones 13 comprising stone 12 have different shapes. One stone may, for example, be round and smooth; another stone may have flat, angular surfaces.

A further example of a selected shape distribution is a distribution in which stones 13 each have rough faces that co-terminate along edges. The stones are crushed stones and although each stone generally consists of angular faces, the sizes of the respective angular faces on one stone differ and also tend to vary from the sizes of the angular faces on other stones.

One example of a selected size distribution is a distribution in which each stone 13 has substantially the same maximum width, as is the case with stones comprising pea gravel.

Another example of a selected size distribution is a distribution in which stones 13 are included that have differing maximum widths, as is the case with ABC gravel.

One example of a selected color distribution is a distribution in which each stone has the same color or substantially the same color. For example, stone mixes are available in which each stone is pink.

Another example of a selected color distribution is a distribution that includes stones of differing color. River rock typically has stones that are blue, stones that are grey, and stones that are white or light colored.

For sake of discussion, and not limitation, it is assumed that the defined configuration of stone 12 comprises stones 13 having a maximum width of about three-fourths of an inch, having a pink color, and having a crushed stone shape consisting of rough, angular faces that co-terminate along edges.

Stone 19 consists of stones 20. Stone 19 has a defined configuration corresponding to the defined configuration of stone 12. Stone 19 is permanently affixed to surface 18 by a layer of adhesive 25.

Stone 21 consist of stones 22. Stone 21 has a defined configuration corresponding to the defined configuration of stone 12. Stone 21 is permanently affixed to surface 16 by a layer of adhesive 24. As is indicated in FIG. 2, after adhesive layer 24 (or 25) is applied to surface 16 (or 18) stones 22 (or 20) are dropped on and adhere to adhesive layer 24 (or 25). When the viewing angle A or line of sight from a viewer's eyes is less than fifteen degrees, preferably less than thirty degrees, the viewer can not visually determine the exact location of box 14. The viewer only sees a ground cover comprised of stone. As the distance from box 14 increases, angle A decreases. When a viewer walks sufficiently close to box 14 and angle A increases sufficiently, the viewer can make out the opening 60 that is intermediate the peripheral edge 61 of cover 15 and the peripheral edge 62 of surface 18. Therefore, one important advantage of the invention is that stones 20, 22 in effect make box 14 disappear from view when a viewer is a distance from box 14 that is sufficient to reduce the viewing angle A such that opening 60 is no longer visible. Another important advantage of the invention is that fixed stones 20, 22 function like a filter and capture particles and other stones that contact or fall onto stones 20, 22. Stones or particles smaller than stones 20, 22 tend to fall intermediate the stones 20, 22. Stones that are the same size as or larger than stones 20, 22 tend to interlock with and be captured by stones 20, 22. This helps prevent stones and particles from falling into opening 60. Preventing stones and particles from falling into opening 60 and then into box 14 is important because as the stone and particles accumulate inside box 14 over time, they interfere with operation of valves in the box, degrade operation of the valves, and hasten the time when the valves must be replaced. Replacement of valves can become a major expense, especially in the case of municipal water valves that are provided with each residential and commercial building in order to turn the water supply to such structures on and off.

In FIG. 1, although the quantity of stones 20 applied to surface 18 can vary as desired, a quantity of stones sufficient to completely cover surface 18 ordinarily is applied to surface 18. Similarly, although the quantity of stones 22 applied to surface 16 can vary as desired, a quantity of stones sufficient to completely cover surface 16 ordinarily is applied to surface 16.

Figure 3:
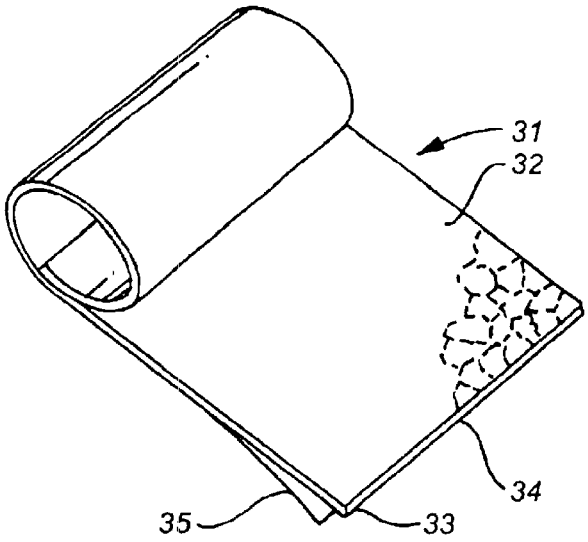
FIG. 3 is a perspective view illustrating a roll of material constructed in accordance with the invention.

FIG. 3 illustrates a roll 31 of sheet material having a leading edge 34, a first adhesive layer 32 on the front of the sheet material, and a peel-off backing 35 covering a second adhesive layer 33 on the back of the material. In use, a piece of sheet material sized to fit surface 16 (or 18) is cut from roll 31, the backing is removed from the cut piece, the adhesive 33 on the back of the cut piece is applied to surface 16 to affix the cut piece to surface 16, and stones 22 are applied to the adhesive 32 on the front of the cut piece to affix the stones to the adhesive 32. If desired, roll 31 can be produced with stones 34 affixed to adhesive 32 or to the front of the sheet material. Stones 34 can be comprised of naturally occurring material or can be imitation stones fabricated from polymers or some other materials. When stones 34 are fabricated from a polymer, the size distribution, color distribution, and shape distribution of stones 34 can vary as desired, and, the stones can be integrally formed on a sheet or attached to a sheet comprising a roll 31. Any desired means can be utilized to affix stones 22 (or 20) to surface 16 (or 18). The sheet can be stored flat.

Figure 4:
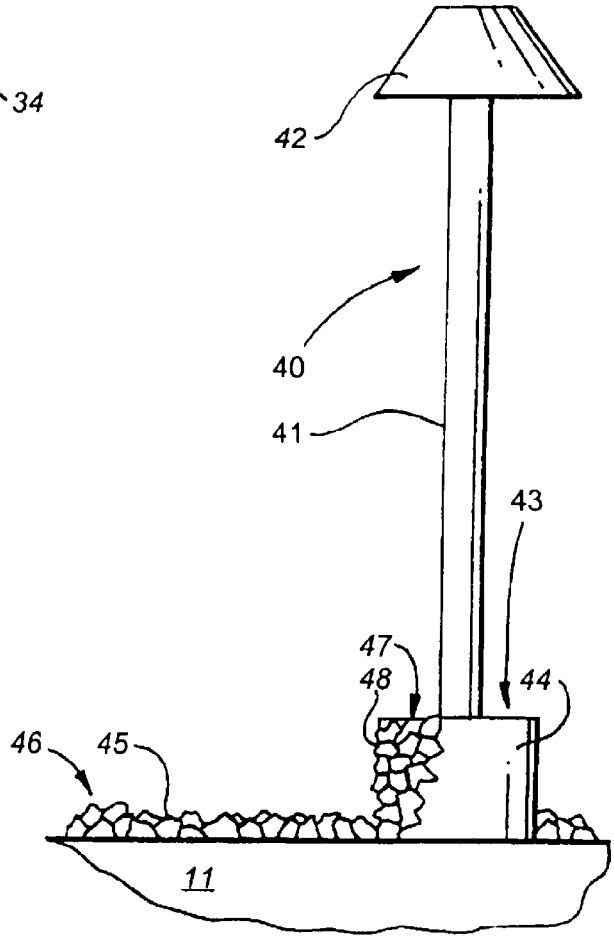
FIG. 4 is a side elevation view illustrating a light post found on grounds adjacent a building structure and illustrating dissimulation of the base of the light post in accordance with the principles of the invention.

In FIG. 4, lamp 40 includes shade 42 mounted on post 41. Post 41 is mounted on base 43. Base 43 includes vertically oriented cylindrical side surface 44. Stone 47 is permanently affixed to surface 44. The stones 48 comprising stone 47 have a size distribution equivalent to that of the stones 45 comprising the stone 46 ground cover adjacent base 43.

Stones 48 need not have the same size, color, and/or shape distribution as stones 45. Utilizing stones 48 having a different size, color, and/or shape distribution than stones 45 may be advantageous and still accomplish the intended functions of the invention, namely, capturing particles and/or dissimulating surface 44. Similarly, stones 20, 22 need not have the same size, color, and/or shape distribution as stones 13. Utilizing stones 20, 22 having a different size, color, and/or shape distribution than stones 13 may be advantageous and still accomplish the intended functions of capturing particles and/or dissimulating surfaces 16 and 18.

Figure 5:
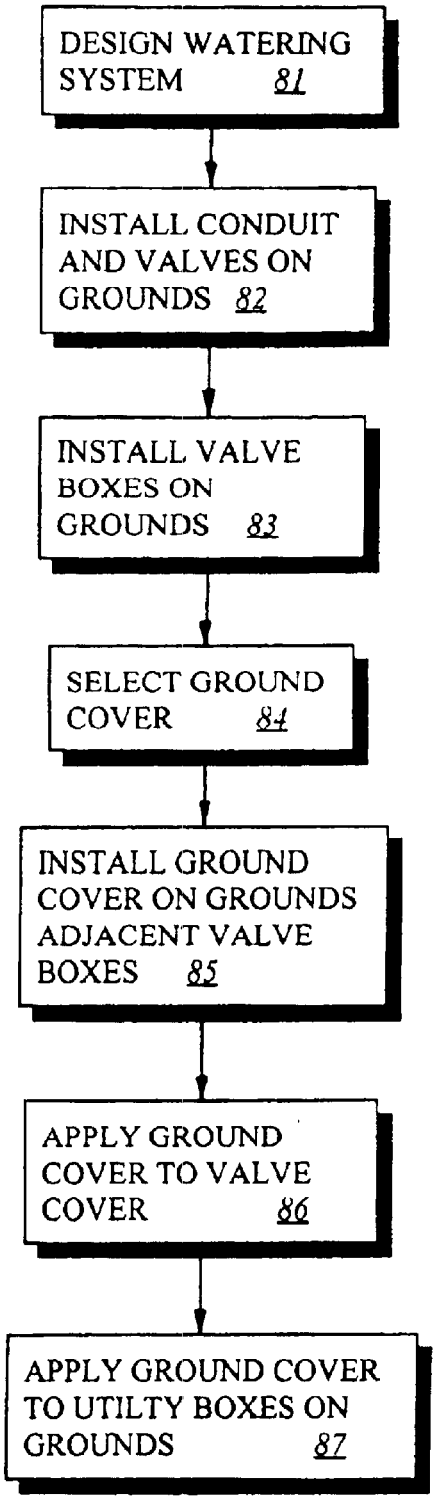
FIG. 5 is a block flow diagram illustrating a dissimulation method in accordance with the invention.

The construction system set forth in FIG. 5 includes step 81 "design watering system", step 82, "install conduit and valves on grounds", step 83, "install valve boxes on grounds", step 84 "select ground cover", step 85 "install ground cover on grounds adjacent valve boxes", step 86 "apply ground cover to valve box cover", and step 87 "apply ground cover to utility boxes on grounds".

Figure 6:
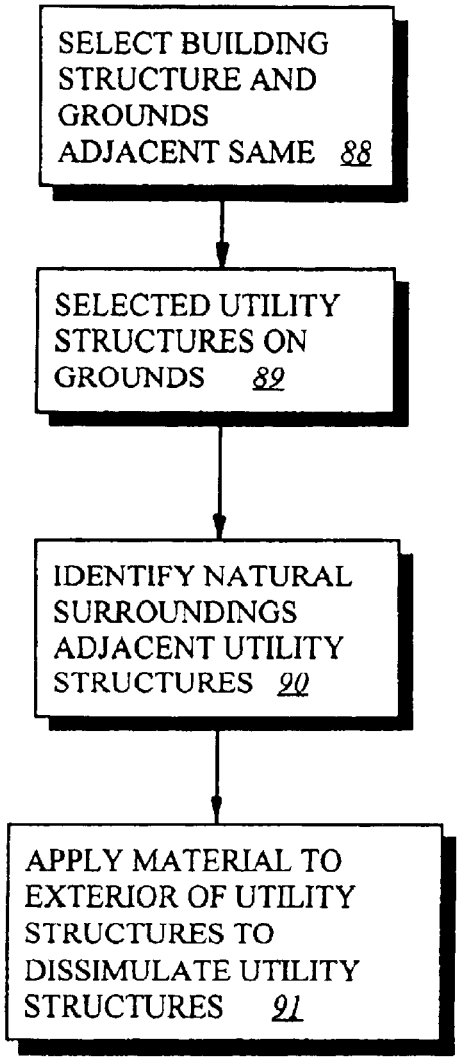
FIG. 6 is a block flow diagram illustrating a construction system in accordance with the invention; and, FIG. 7 is a block flow diagram illustrating a construction system in accordance with the invention.

The construction system set forth in FIG. 6 includes step 88 "elect building structure and grounds adjacent same", step 89 "select utility structures on grounds", step 90 "identify natural surroundings adjacent utility structures", and step 91 "apply material to exterior of utility structures to dissimulate utility structures".

Figure 7:
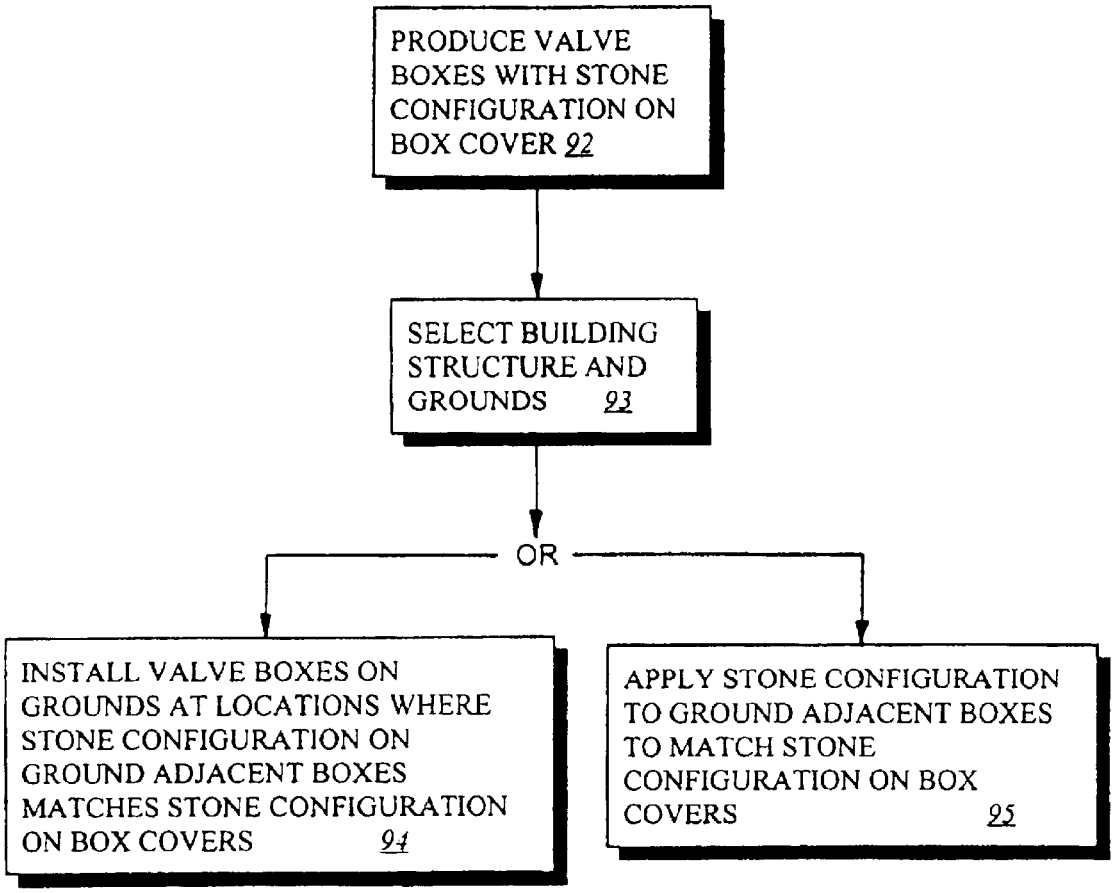

The construction system set forth in FIG. 7 includes step 92 "produce valve boxes with stone configuration on outer32 top surface of box cover", step 93 "select building structure and grounds", and step 94 "install valve boxes on grounds at location where stone configuration on ground adjacent boxes matches stone configuration on box covers", or, step 85 "apply stone configuration to ground adjacent boxes to match stone configuration on box covers".

Having described my invention in such terms as to enable those of skill in the art to make and practice it, and having described the presently preferred embodiments thereof, I claim:

1. A construction method for altering an aesthetic appearance of desert landscaping by dissimulating at least one out-of-doors artificial structure, and capturing loose particles said method including the steps of (a) selecting a building structure including grounds comprising a ground and landscaping on the ground, at least a portion of the grounds including desert landscaping comprising stones on the ground, said building structure including a watering system including (i) at least one conduit having a proximate end and a distal end, (ii) at least one valve in said portion of the grounds on said proximate end of said conduit, (iii) at least one water distribution valve at said distal end of said conduit, and (iv) a valve box housing said valve and including a cover having an outer top surface;

(b) locating said valve box on the grounds;

(c) defining the configuration of said desert landscaping stones to generate a defined configuration, said defined configuration including a
(i) size distribution,
(ii) shape distribution, and
(iii) color distribution;

(d) supplying auxiliary stones having said defined configuration; and, (e) dissimulating said cover and producing a particle filter by securing said auxiliary stones to said outer top surface of said cover.

* * * * *